United States Patent [19]

Braastad

[11] Patent Number: 5,060,798

[45] Date of Patent: Oct. 29, 1991

[54] PAPERBOARD HOLDER FOR FLOWER VASES AND THE LIKE

[76] Inventor: Kenneth A. Braastad, 717 - 157th Ave. NE., Ham Lake, Minn. 55304

[21] Appl. No.: 665,914

[22] Filed: Mar. 4, 1991

Related U.S. Application Data

[63] Continuation of Ser. No. 557,722, Jul. 25, 1990, abandoned.

[51] Int. Cl.[5] ..... B65D 85/52

[52] U.S. Cl. ..... 206/423; 206/477; 206/482; 248/152

[58] Field of Search ..... 206/423, 477, 478, 482, 206/480, 486, 490, 495, 805; 215/100.5; 229/87 P; 248/152, 346, 346.1

[56] References Cited

U.S. PATENT DOCUMENTS

| | | | |
|---|---|---|---|
| 583,925 | 6/1897 | McGowan | 206/423 |
| 681,066 | 8/1901 | Millingar | 206/423 |
| 760,886 | 5/1904 | Lord | 206/423 |
| 1,156,074 | 10/1915 | Hahn | 206/482 |
| 1,954,006 | 4/1934 | Wolf | 206/423 |
| 2,264,489 | 12/1941 | Tiegler et al. . | |
| 2,332,642 | 10/1943 | Johnson | 206/805 |
| 2,973,860 | 3/1961 | Cohen | 206/482 |
| 3,138,316 | 6/1964 | Meyer . | |
| 3,297,289 | 1/1967 | Raus . | |
| 3,780,854 | 12/1973 | Ruppenthal | 206/478 |
| 3,814,239 | 6/1974 | McGinley et al. | 206/423 |
| 3,881,674 | 5/1975 | Greene, III . | |
| 4,204,598 | 5/1980 | Adams . | |
| 4,681,224 | 7/1987 | Niemann . | |
| 4,726,468 | 2/1988 | Hesser et al. . | |
| 4,767,089 | 8/1988 | Self . | |
| 4,809,848 | 3/1989 | Rozmestor | 206/805 |
| 4,819,803 | 4/1989 | Neiser . | |
| 5,005,760 | 4/1991 | van den Hoogen | 206/423 |

*Primary Examiner*—David T. Fidei

*Attorney, Agent, or Firm*—Peterson, Wicks, Nemer & Kamrath

[57] ABSTRACT

A paperboard or cardboard blank has quandrantally located tabs die cut therein and inwardly located score or weakened fold lines. Outwardly spaced from the fold lines, that is, near the free ends of the tabs, are pairs of holes. With the exception of the holes in one tab, each hole in the other tabs has a slit and an entrance notch so as to faciltiate the entrance of a portion of a ribbon. Whereas the tabs have holes formed therein, the blank has an additional first and second hole spaced from the tabs and also from each other, each having a slit and entrance notch to facilitate the insertion of a portion of a ribbon into the first and second holes. The blank has a square configuration, two corners thereof being provided with pairs of holes, each hole of each pair in the corners having slits and notches so as to also facilitate the insertion of ribbon portions so that the remaining end lengths of the ribbons can be wrapped around to anchor the ribbons after the ribbons, there being two, have been pulled taut to cause the tabs to tightly engage the sides of the vase and thus hold the vase in a stabilized vertical position for transportation.

22 Claims, 2 Drawing Sheets

46
42
44
44
46
48c
50b
38
18d
30
32
36
50c
48d
46
18c
26
50
44
20d
20d
22
22
40
24
50a
36
34
48b
18a
18b
48
48a
44
20d
20d
46
22
22
38
50d
60

46
44
46
44
46
44
40
20b
26
30
30
42
44
46
18c
20a
20c
28
36
32
36
34
30
20a
30
38
20c
18d
38
20d
20b
20b
20d
20d
28
26
28
24
26
20d
20a
30
20c
30
18b
18a
20c
20a
16
20b
26

PAPERBOARD HOLDER FOR FLOWER VASES AND THE LIKE

This is a continuation of application Ser. No. 557,722, filed on July 25, 1990, now abandoned.

BACKGROUND OF THE INVENTION

1. Field of the Invention

This invention relates generally to holders for transporting flower vases and the like in an upright position, and also pertains to a paperboard blank from which the holder is fabricated.

2. Description of the Prior Art

The problem of stabilizing vases containing flowers, as well as other items, in an upright position while they are being transported has been recognized for a number of years. Attempts have been made to provide appropriate holders and some are relatively reliable, but can be quite costly.

Although I am not personally acquainted with the actual holder described in U.S. Pat. No. 3,297,289 granted on Jan. 10, 1966 to Julius La Raus, this patent discloses a holder having some general similarities to the holder I have devised. However, the holder is relatively complex and costly to manufacture, and is not completely reliable in maintaining vases and the like in an upright position. For instance, reliance is made on the inherent resiliency of a number of tabs that initially extend inwardly from outwardly located score lines and are flexed upwardly in order to accommodate the base of the vase to be maintained upright. The resiliency of the tabs, however, does not provide a sufficient degree of rigidity so as to assure that the vase will at all times remain vertical. Hence, a simpler and more reliable holder is needed in order to overcome the shortcomings of the holder described in Patent '289.

SUMMARY OF THE INVENTION

One object of the present invention is to provide a holder for vases and the like which is exceedingly reliable in stabilizing and maintaining vases and similar articles in an upright position.

Another object of the invention is to provide a holder for vases and the like that is inexpensive to manufacture, enabling the purchaser to discard or throw away the holder after it has served its purpose in safely transporting the vase to its destination.

Also, the invention has for an object the provision of a holder that will accommodate a range of vase sizes, although it is planned that several different holders be fabricated so as to provide a means for satisfactorily stabilizing virtually all vases that are currently being used by florists in the marketing of flowers.

Yet another object is to provide a holder that is not restricted to holding vases with flange-type bases, my holder being suitable for vases that have either flange-type bases or those without such a type of base.

An important object of the invention is also to enable the florist to partially erect the holder from a flat blank, doing so in advance of its needed use and when he or she is not busy. Thus, an aim of the invention is to provide a holder that can be employed quickly at the point of sale without requiring the customer to wait while an elaborate or complex erection procedure is pursued.

Still another object of the invention is to provide a one-piece blank having a large supporting surface that firmly stabilizes the particular item to be maintained in an upright condition and which will be aesthetically attractive. Actually, the cardboard or paperboard blank can be variously colored and is of sufficient size so as to contain thereon, if desired, suitable advertising, such as the florist's name and address plus suitable special occasion messages.

Briefly, my invention contemplates a cardboard or paperboard blank that is suitably die cut to provide quadrantally located tabs that can be flexed upwardly in preparation for accommodating a base, pot, urn or the like. The tabs are flexed upwardly about weakened fold lines and the free outer ends thereof are provided with a pair of holes in each instance. One of the tabs has only the pair of holes formed therein, but the remaining three have slits and notches enabling ribbons or cords to be more readily inserted into the pairs of holes of those particular three tabs. Additional holes are provided outwardly relative to the tabs and these holes also have slits and notches so that the ribbons or cords can be not only inserted into certain of the additional holes in order to partially erect the holder, but also allowing the ribbons or cords to be threaded into the remaining additional holes and wrapped so as to secure the end portions of the ribbons or cords. When the ribbons or cords are pulled taut, whatever size of vase or other item to be held is securely engaged by the upper portions of the tabs. In other words, the tabs are drawn tightly against the outer surface of whatever container is to be held upright.

DESCRIPTION OF THE PREFERRED EMBODIMENT

Although my holder is capable of maintaining a variety of items in an upright position, such as fragile figurines and potted plants, a vase 10 has been selected as the item to be vertically transported. The particular vase 10 has a non-flanged base or bottom 12 which has heretofore presented somewhat of a problem with respect to maintaining such a vase in an upright condition. For the sake of completeness, flowers 14 have been shown in the vase 10, the flowers 14 raising the overall center of gravity of the vase somewhat. In other words, a vase containing rather long-stemmed flowers is more likely to tip over, particularly where the vase is slender, than a vase with short-stemmed flowers therein.

Figure 3:
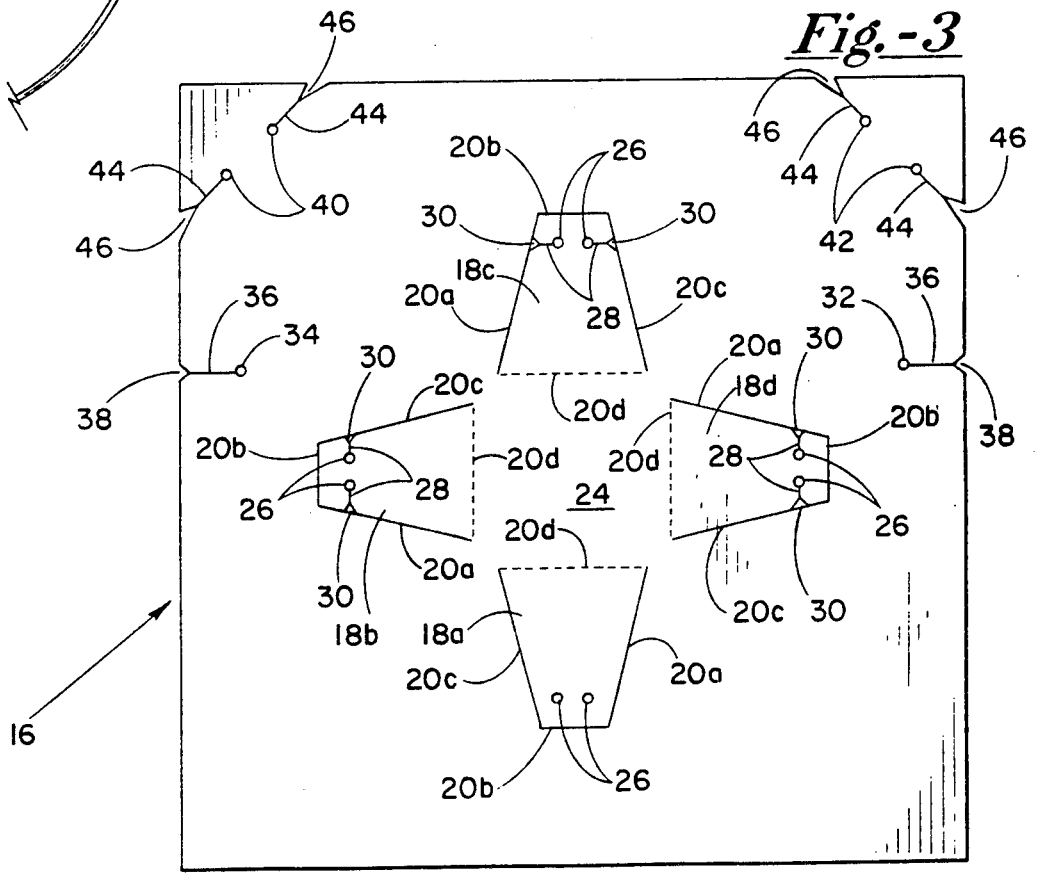
FIG. 3 is a top plan view of the blank from which the holder of FIG. 1 is fabricated, the blank being devoid of the ribbons or cords appearing in FIGS. 1 and 2.

It will be well at this stage to refer to FIG. 3 where a cardboard or paperboard flat blank 16 has been illustrated. Preferably, the blank 16 is of corrugated cardboard, but it will be appreciated that the blank can be of pressed paperboard or even of a flexible plastic material.

It will be observed that there are four quadrantally located tabs 18*a*, 18*b*, 18*c* and 18*d* having a truncated configuration. These tabs 18*a*–18*d* are easily die cut from the paper stock that is contemplated as the material for the blank 16. The die cutting of the tabs 18*a*, 18*b*, 18*c* and 18*d* result in cut lines 20*a*, 20*b* and 20*c* for each tab 18*a*, 18*b*, 18*c* and 18*d*. However, a scored or weakened fold line 20*d* is provided for each of the tabs 18*a*–18*d* in order that they can be readily flexed upwardly. It will be recognized that the die cutting of the tabs 18*a*–18*d* leaves an opening 22 in each instance. It is important to note that the weakened fold lines 20*d* are inwardly located with respect to the free outer ends of the tabs 18*a*–18*d*. The importance of the location of the lines 20*d* will become manifest as the description progresses. At this time, though, it will be observed that the forming of the tabs 18*a*–18*d* provides a central portion labeled 24 upon which the non-flanged base or bottom 12 of the base 10 rests.

Each tab 18*a*, 18*b*, 18*c* and 18*d* has a pair of holes 26 formed therein, the holes 26 being near the free or outer ends of the tabs 18*a* 18*b*, 18*c* and 18*d*, each have slits 28 providing communication from notches 30 located at the edges of these three tabs to the holes 26 in these tabs 18*b*, 18*c* and 18*d*. The purpose of the slits 28 and the notches 30 will soon be made more clear.

Two additional holes 32 and 34 are spaced outwardly and thus near the edges of the blank 16, these holes 32 and 34 each having slits 36 and notches 38. Still more holes in the form of two pairs of holes 40 and 42 are also provided, these holes likewise being near the edges of the blank 16. Each of the holes 40 and each of the holes 42 have slits 44 and notches 46 providing access to the slits 44 to the holes 40 and 42.

At this time attention is directed to two flexible ribbons or cords 48 and 50. The ribbon 48 has one end thereof threaded through one of the holes 26 in the tab 18*a* (which tab can be said to reside at the 6 o'clock position). It will be noted that the holes 26 and the tab 18*a* are devoid of slits 28 and notches 30, thereby enabling the end 48*a* of the ribbon 48 to be threaded through one of the holes 26 and anchored by a simple knot at 48*a*. The same thing can be said for the ribbon 50 in that it has one end tied at 50*a* after being threaded through the other hole 26 in the tab 18*a*.

Figure 1:
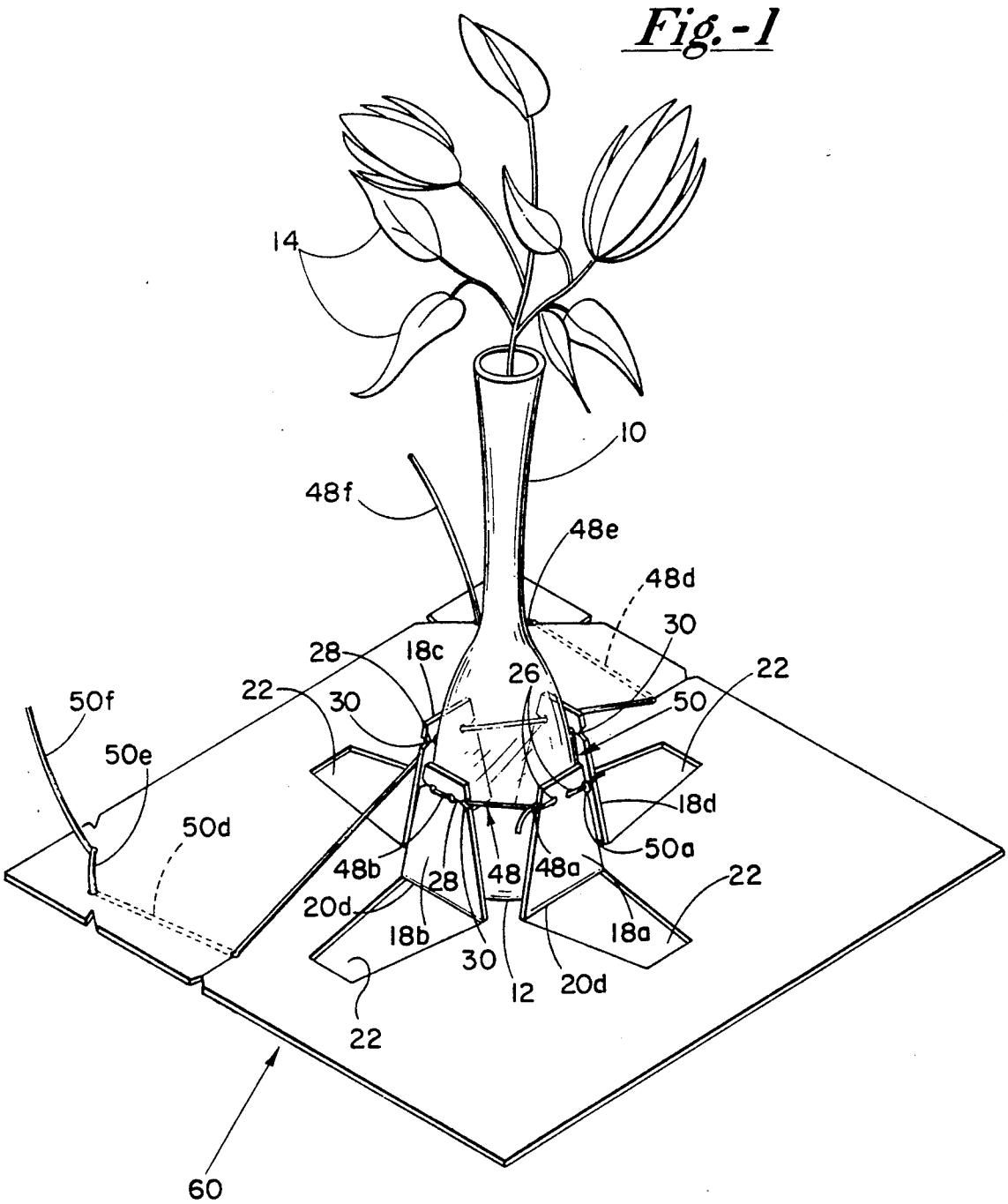
FIG. 1 is a perspective view of my holder supporting a vase in an upright condition.
Figure 2:
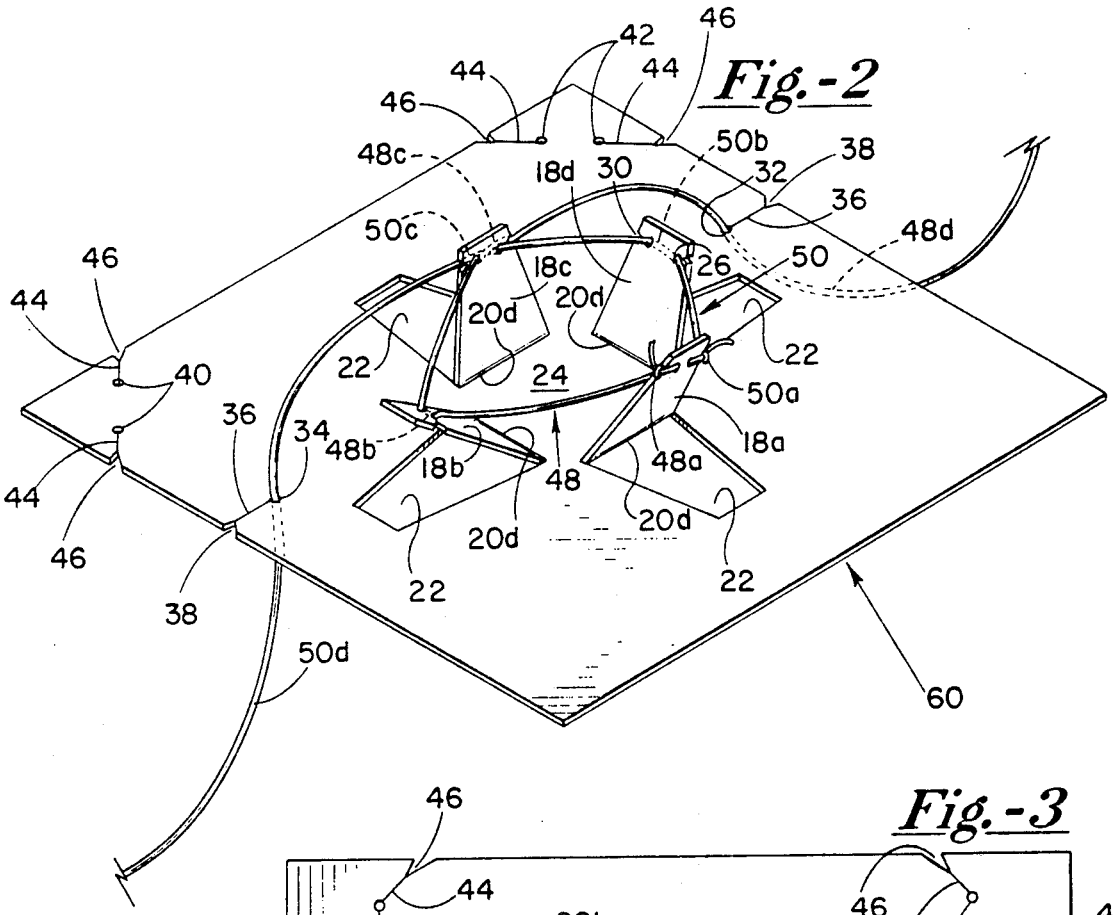
FIG. 2 is a perspective view of my holder in a partially erected condition and without a vase having been placed thereon.

It will be helpful at this point to refer to FIG. 2 which pictures a partially erected holder. Specifically, the ribbon 48 is inserted into one of the holes 26 in the tab 18*b* (9 o'clock position), the notch 30 enabling the ribbon 48 to then be pulled through the slit 28 into one of the holes 26 in the tab 18*b*. The segment of the ribbon 48 that then engages one side of the tab 18*b* has been denoted by the reference numeral 48*b*. The procedure is repeated with the other ribbon 50, it being inserted via one of the notches 30 and slits 28 into one of the holes in the tab 18*d* (3 o'clock position), thereby having the segment labeled 50*b* engaging one side of the tab 18*d*. The portions of the ribbons 48 and 50 on the opposite ends of the segments 48*b* and 50*b* enter the respective holes 26 at the other edge of the tabs 18*b* and 18*d* so that the ribbons 48 and 50 can then be inserted into the holes 26 formed in the remaining tab 18*c* (12 o'clock position), doing so through the respective notches 30 and slits 28. The ribbons 48 and 50 actually cross each other on the far side of the tab 18*c* as viewed in FIGS. 1 and 2, these crossing segments being indicated by the reference numerals 48*c* and 50*c*. Inasmuch as FIG. 2 represents only a partial erection of the holder, the florist then anchors the segments 48*d* and 50*d* of the ribbons 48 and 50, doing so via the notches 38 and the slits 36 providing access for the ribbons 48 and 50 into the holes 32 and 34. Thus, FIG. 2 depicts the holder in a condition ready to accept the vase 10 therein.

Once the vase 10 has been placed on the central portion 24, the florist pulls the two ribbons 48 and 50 tightly so that the tabs 18*a*–18*d* are all brought tightly against the sides of the vase 10. Having done this, then the florist passes the segments 48*e* and 50*e* under the marginal portion of the blank 16 (which is now really the holder that has been given the reference numeral 60) and after doing this the florist introduces a portion of each ribbon 48 and 50 into the holes 40 and 42, doing so via the notches 46 and the slits 44 the portions of the ribbons 48 and 50 can then be wrapped around to provide whatever anchorage is needed. The wrap around segments are indicated by the reference numerals 48*e* and 50*e*, thereby leaving end portions 48*f* and 50*f* that can be of whatever length remains as far as the ribbons 48 and 50 are concerned.

Hence, the firm engagement of the tabs 18*a*–18*d* against the sides of the vase 10 is maintained by reason of the wrap around segments 48*e* and 50*e*. It will be appreciated that the condition of the holder 60 shown in FIG. 2 can be achieved at any time when the florist has a free moment and completed in the presence of the customer who is to transport the vase 10 and flowers 14. The holder 60 is exceedingly stable and can be readily placed on the foor or seat of a vehicle without the likelihood of the combination tilting. In other words, an exceedingly stable condition of the vase 10 is achieved.

The herein referred to clock positions of the tabs 18*a*, 18*b*, 18*c* and 18*d* correspond generally to the relation of the tabs as they appear in the drawings.

I claim:

1. A blank of cardboard or paperboard for use in forming a holder for items such as flower vases comprising, in combination: a generally planar panel having a plurality of angularly oriented tabs, with each of said tabs having at least first and second edges, an inwardly located weakened fold line, and at least a first tab hole located in the tab remote from the weakened fold line and the first and second edges, and in which certain of said tabs have slits extending from the first edge to the tab hole for the forceable passage of portions of a ribbon or cord through the slits for insertion into said tab holes.

2. A blank in accordance with claim 1 in which each tab has two tab holes located remotely from their weakened fold line and their first and second edges.

3. A blank in accordance with claim 1 further comprising, in combination: an entrance notch located on the edge of the tab and associated with each of the slits for initially positioning the portions of ribbon or cord for passage through the slit.

4. A blank in accordance with claim 3 in which said panel has first and second panel holes spaced outwardly from said tabs and spaced from each other.

5. A blank in accordance with claim 4 in which the planar panel has at least first and second edges, and in which each of said first and second panel holes has a panel slit extending from one of the edges of the planar panel to the panel hole for the forceable passage of the portion of ribbon or cord into said first and second panel holes.

6. A blank in accordance with claim 5 further comprising, in combination: an entrance notch located on one of the edges of the planar panel and associated with each of said first and second panel holes for initially positioning and portions of ribbon or cord for passage through the panel slits.

7. A blank in accordance with claim 6 in which said panel is rectangular, providing four corners, two of said corners each having an additional pair of holes formed in the corners spaced from the edges of the panel.

8. The blank of claim 7 in which each of said additional pair of holes has a slit extending from the edge of the panel to the hole for the passage of the portion of ribbon or cord into said additional pairs of holes.

9. A blank in accordance with claim 8 in which each of said last-mentioned slits has an entrance notch located at the edge of the panel.

10. A blank of paperboard or cardboard for use in forming a holder for holding items in a stabilized vertical position, with the item having a base and sides upstanding from the base, comprising, in combination: a rectangular panel having a plurality of tabs located quandrantally around a central portion, each tab having at least first and second die cut edges and a weakened fold line, said respective fold lines residing inwardly of said die cut edges and defining the central portion, with the central portion being planar and of a size for acception the base of the item, said tabs being flexible upwardly about the weakened fold lines to engage the sides of the item above the base of the item, with said tabs each having a pair of laterally spaced holes located outwardly with respect to their fold lines of said tabs, and a marginal portion extending from the central portion and intermediate the tabs providing a large supporting surface; and ribbon means passing through the pairs of holes in said tabs to hold the tabs against the sides of the item.

11. A blank in accordance with claim 10 in which said marginal portion of said panel has first and second holes spaced outwardly from said tabs and from the central portion and spaced from each other, said ribbon means also passing through said outwardly spaced first and second holes.

12. A blank in accordance with claim 11 in which the marginal portion has edges and in which said first and second holes each have a slit extending from the edge of the marginal portion to the hole and through which said ribbon means can be forceably passed for insertion into the hole.

13. A blank in accordance with claim 12 in which each of said slits has a notch at the edge of the marginal portion for facilitating the forceable passage of said ribbon means through said slits into the holes of said first and second outwardly spaced holes.

14. A blank in accordance with claim 13 in which first, second, third, and fourth tabs are provided and in which said ribbon means includes first and second ribbons, said first ribbon having one end tied to said first tab via said one hole, said second ribbon having one end tied to said first tab via the other of the holes in said first tab, said first ribbon passing through the pairs of holes of the second tab, said second ribbon passing through the pair of holes of the third tab, said ribbons then passing through the holes in the fourth tab.

15. A holder of paperboard or cardboard for holding an item in a stabilized vertical position, with the item having a bottom and sides upstanding from the bottom, comprising, in combination: a planar panel; a central portion of said panel underlying the bottom of said item in the plane of the planar panel; a number of angularly disposed upwardly extending tabs formed in the planar panel and hingedly connected to said central portion, with the tabs having upper end portions spaced from the central portion, with the tabs being flexible upwardly at an angle to the plane of the planar panel to engage the upper end portions of said tabs against the sides of the item spaced above the bottom of the item; a marginal portion extending from the central portion in the plane of the planar panel and intermediate the tabs providing a large supporting surface; and means for holding the upper end portions of said tabs against said sides of the item.

16. The holder of claim 15 in which the upper end portion of each of said tabs has a hole therein, and in which said holding means comprises a ribbon extending through said holes of said tabs.

17. The holder of claim 16 in which first, second, third and fourth tabs are provided, with the first tab located at a 12:00 o'clock position, the second tab located at a 3:00 o'clock position, the third tab located at a 6:00 o'clock position, and the fourth tab located at a 9:00 o'clock position, said ribbon being anchored to the third tab via its hole, said ribbon passing through the holes in the second and fourth tabs, said ribbon passing through said hole in said first tab.

18. The holder of claim 17 including means for anchoring said ribbon to said marginal portion of said panel spaced from the central portion and said tabs.

19. The combination holder of claim 18 in which said anchoring means includes a pair of holes spaced outwardly from said tabs, said ribbon passing through said outwardly spaced holes.

20. The holder of claim 19 in which said marginal portion of said panel is rectangular having four corners, two of said corners each having still another pair of holes, and said ribbon passing through the holes in said two corners.

21. The holder of claim 20 in which each tab includes an edge, with the second, third, and fourth tabs each having a slit extending from the edge of the tab to the hole in the tab for the forceable passage of the ribbon into the hole and a notch associated with each slit located at the edge of the tab for facilitating the insertion of the ribbon into the slit.

22. The blank in accordance with claim 10 wherein at least first and second tabs are provided; and wherein the ribboned means includes a central portion anchored to the first tab and first and second free ends, with the first free end of the ribbon means passing through one of the pair of holes of the second tab and the second free end of the ribbon means passing through the other of the pair of holes of the second tab.

* * * * *

UNITED STATES PATENT AND TRADEMARK OFFICE

CERTIFICATE OF CORRECTION

PATENT NO. : 5,060,798

DATED : October 29, 1991

INVENTOR(S) : Kenneth A. Braastad

It is certified that error appears in the above-identified patent and that said Letters Patent is hereby corrected as shown below:

Column 3, line 14, cancel "18d," and substitute therefor --18d. Tabs 18b, 18c and 18d,--.

Column 4, line 31, cancel "such as flower vases".

Column 4, line 63, cancel "and" and substitute therefor --the--.

Column 5, line 18, cancel "tion" and substitute therefor --ting--.

Signed and Sealed this

Twenty-third Day of February, 1993

*Attest:*

STEPHEN G. KUNIN

*Attesting Officer*

*Acting Commissioner of Patents and Trademarks*